United States Patent [19]

McBarron

[11] 4,438,573

[45] Mar. 27, 1984

[54] VENTILATED ATHLETIC SHOE

[75] Inventor: George P. McBarron, Attleboro, Mass.

[73] Assignee: Stride Rite International, Ltd., Cambridge, Mass.

[21] Appl. No.: 281,315

[22] Filed: Jul. 8, 1981

[51] Int. Cl.[3] ..... A43B 7/06; A43B 13/20

[52] U.S. Cl. ..... 36/3 B; 36/29

[58] Field of Search ..... 36/3 R, 3 A, 3 B, 28, 36/29

[56] References Cited

U.S. PATENT DOCUMENTS

| | | | |
|---|---|---|---|
| 2,010,151 | 8/1935 | Helwig | 36/3 B |
| 2,558,973 | 7/1951 | Meaker | 36/3 B |
| 4,078,321 | 3/1978 | Famolare, Jr. | 36/3 B |
| 4,235,026 | 11/1980 | Plagenhoef | 36/3 B |
| 4,236,326 | 12/1980 | Frohara | 36/3 B |

*Primary Examiner*—Patrick D. Lawson

[57] ABSTRACT

In an athletic shoe, a system for conveying air into the shoe in which an air reservoir in the resilient outsole assembly is open to a first transverse air channel which opens in turn to the surrounding air, a longitudinal air slot in the outsole assembly is open to the air reservoir, a first vertical hole in the top of the outsole assembly is open to the air slot and to a second vertical air hole in the insole board, the second vertical hole in turn is open to an air channel in the bottom of the slipsole, and the slipsole air channel is open to third vertical holes in the slipsole which open into the inside of the shoe under the user's foot; the air reservoir, air slot, first air holes and second air holes can lie on the midline of the sole assembly; and the slipsole air channels can be arranged in a grid covering the entire bottom of the slipsole with the first air holes, second air holes and third air holes arranged at the intersection points on the grid.

8 Claims, 8 Drawing Figures

FIG 1
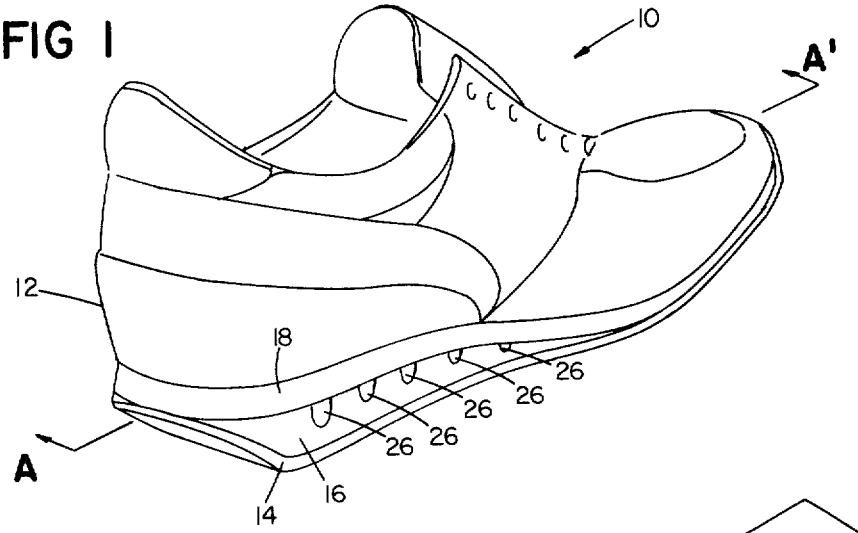
FIG 2
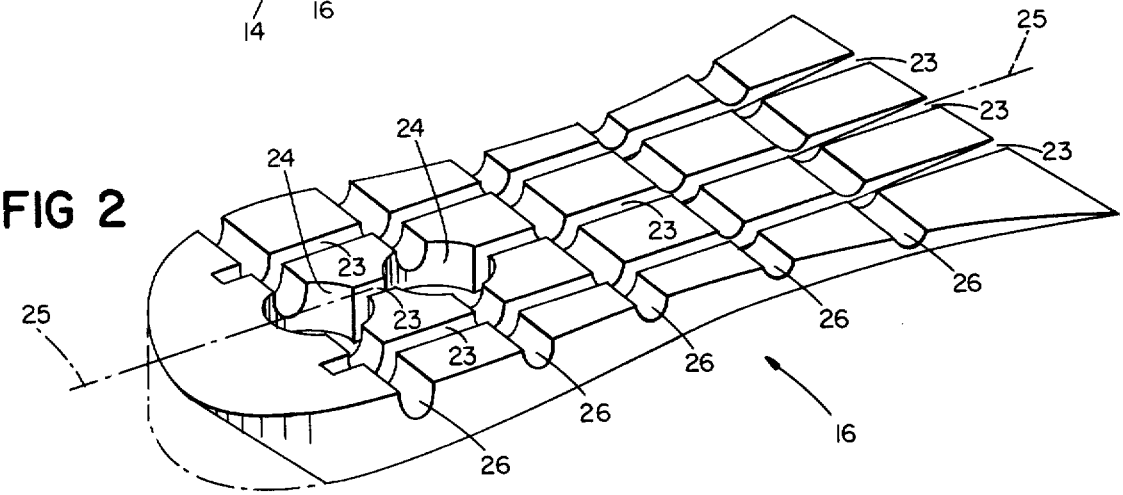
FIG 7
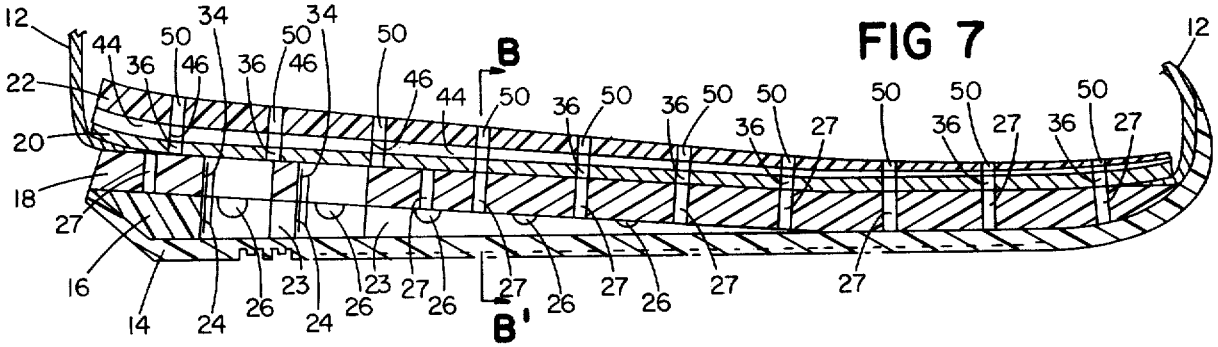
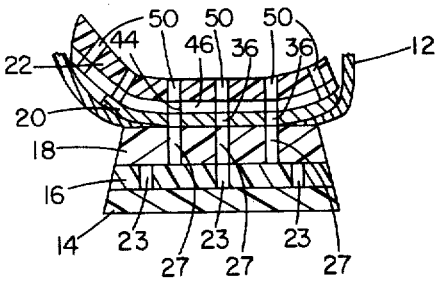
FIG 8

FIG 3
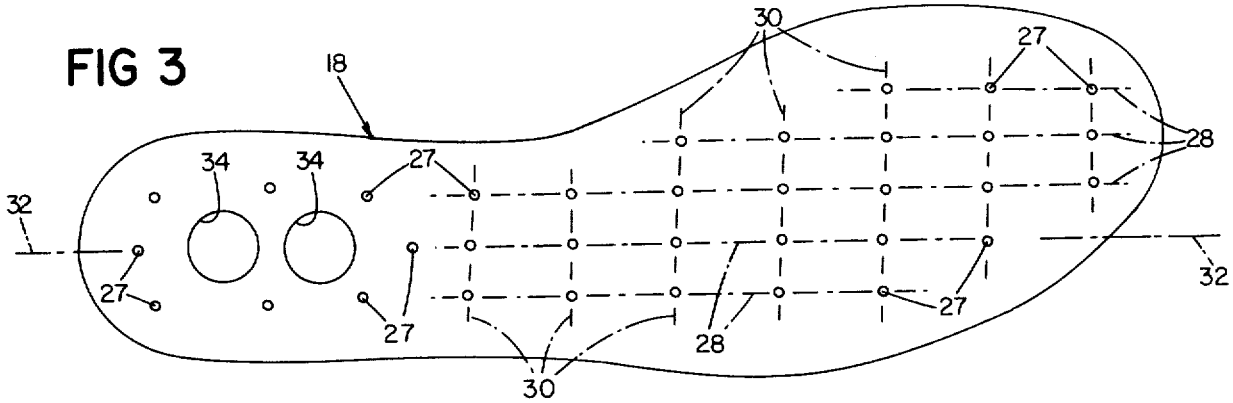
FIG 4
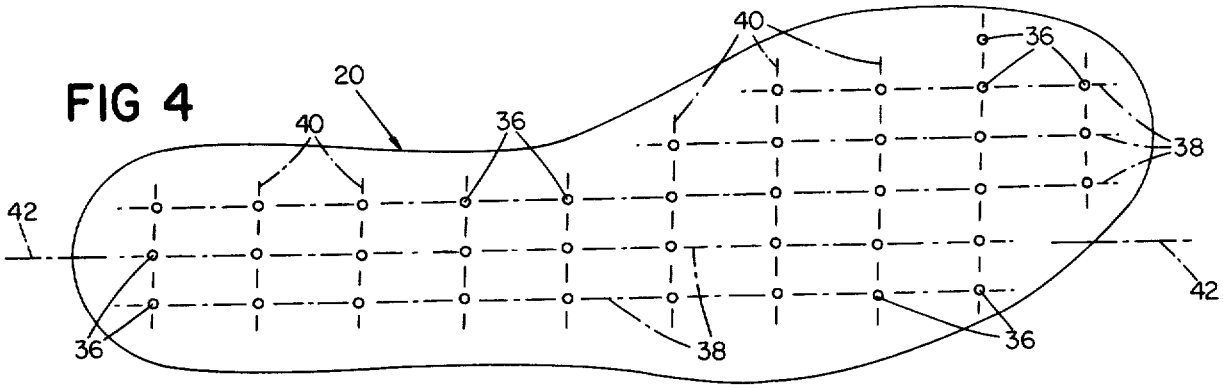
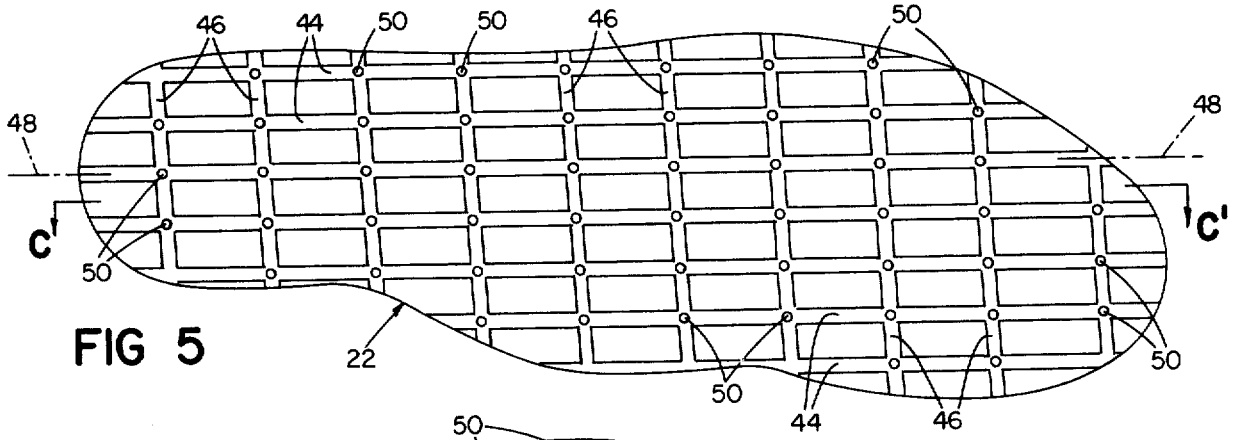
FIG 5
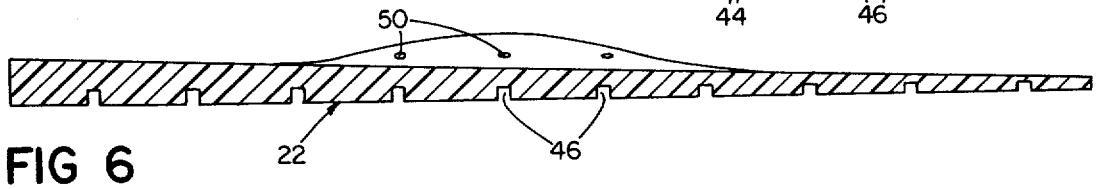
FIG 6

VENTILATED ATHLETIC SHOE

BACKGROUND OF THE INVENTION

This invention relates to athletic shoes and particularly athletic shoes which ventilate and cushion the user's foot from shock.

In available athletic shoes, ventilating and shock cushioning mechanisms include transverse air channels in the heel portion of the outsole assembly, longitudinal slots open to the transverse air channels and vertical holes through the heel portion of the insole and the outsole assembly to connect the transverse air channels to the inside of the shoe and, in some such shoes, the slipsole may have channels on its underside and holes through it to transmit air to the bottom of the user's foot. The orientations of the slipsole channels do not correspond with the vertical holes through the insole, the locations of the holes through the slipsole do not generally correspond with the locations of the slipsole channels, and for these and other reasons the extent to which such shoes ventilate and provide shock cushioning is not fully satisfactory.

SUMMARY OF THE INVENTION

The objects of the present invention are to provide improved ventilation and shock cushioning by increasing the amount of air which will flow into the shoe, by including air reservoirs and air slots for holding volumes of ventilation air and enhancing the air flow, and by extending the flow of air to all points under the user's foot through air slots and air channels.

In general, the invention features in one aspect in an athletic shoe for ventilating the user's foot having a transverse first air channel in the resilient outsole assembly of the shoe open at its ends to the surrounding air and means for conveying air from the first air channel into the shoe, the improvement comprising an air reservoir cut vertically into the outsole assembly and open through its side wall to the first air channel; an air slot cut longitudinally into the outsole assembly and open in one section to the air reservoir; a first air hole cut vertically into the top of the outsole assembly at a point spaced from the air reservoir and open to the air slot; a second air hole cut into the insole board of the shoe and arranged to communicate with the first air hole; a second air channel cut into the bottom of the resilient slipsole of the shoe and open to the second air hole; and at least two third air holes cut vertically into the slipsole and arranged to communicate with the second air channel and with the inside of the shoe; the improvement enables the easy flow of ventilating air into the shoe and provides cavities in which volumes of ventilating air may be held. The force of the user's foot against the ground enhances the flow of air into the shoe, and the user's foot is cushioned from shock. In preferred embodiments, the air reservoir, air slot, first air hole and second air hole are located on the midline of the outsole assembly; the outsole assembly includes a midsole, a heel wedge and a sole cover with the air reservoir cut through the midsole and the heel wedge, the air slot cut through the heel wedge, and the first air hole cut into the midsole; the second air channels are arranged on a grid over the whole slipsole and the first air holes, second air holes and third air holes are located at the grid intersection points; and the first air holes, second air holes and third air holes are between about 1/16" and 3/16" in diameter.

In another aspect, the improvement comprises at least one air reservoir cut vertically into the outsole assembly so that a volume of air is held in said air reservoir; the force of the user's foot against the ground enhances the flow of air into said shoe, and the user's foot is cushioned from shock.

In another aspect, the improvement comprises a grid of second air channels over the whole bottom of the slipsole and air holes cut through the slipsole into the intersection points of the grid of second air channels, so that air is distributed along the channels to all points under the user's foot, and the user's foot is cushioned from shock.

The invention greatly increases the volume of air flowing into the shoe by providing larger and more numerous air holes and channels and arranging the air holes and channels in an effective grid pattern; provides an effective air pumping mechanism in the form of air reservoirs and air slots cut into resilient sole pieces which greatly enhances the flow of air into the shoe; assures the flow of air to all parts of the shoe by extending the air slots to a point more than halfway from the back end to the front end of the shoe and extending the grid of air channels under the slipsole to all points under the user's foot; and cushions the user's foot against shock by means of air held in the cavities inside the resilient sole pieces.

DESCRIPTION OF THE PREFERRED EMBODIMENT

We turn now to the structure and operation of the preferred embodiment, first briefly describing the drawings thereof.

Drawings

FIG. 1 is a perspective view of an athletic shoe according to the invention.

FIG. 2 is a perspective view of the heel wedge of said athletic shoe.

FIG. 3 is a plan view of the midsole of said athletic shoe.

FIG. 4 is a plan view of the insole board of said athletic shoe.

FIG. 5 is a bottom view of the slipsole of said athletic shoe.

FIG. 6 is a sectional view of said slipsole (at C—C' in FIG. 5).

FIG. 7 is a sectional view at the longitudinal midline at A—A' in FIG. 1) of said athletic shoe.

FIG. 8 is a sectional view across the heel (at B—B' in FIG. 7) of said athletic shoe.

Structure

There is shown in FIG. 1 a size 9½ athletic shoe 10 having shoe upper 12, outsole 14, heel wedge 16 and midsole 18.

Heel wedge 16, as shown in FIG. 2, is a wedge of ethylene vinyl acetate (EVA) sponge tapered in thickness toward the front of the shoe with the back end of wedge 16 being 22 iron thick. Three parallel ⅛" wide slots 23 are cut longitudinally through the full depth of wedge 16 beginning at a distance of 1" from the back end of wedge 16 and continuing to the front end of wedge 16. The middle slot 23 lies on midline 25 of wedge 16, and the other two slots 23 lie a distance of ¾" on either side of the middle slot. Slots 23 may vary in width provided they are sufficiently wide to permit the flow of air but not so wide as to weaken substantially the structural integrity of wedge 16, e.g., between about ⅛" and about ¼" wide. Two ¾" diameter air reservoirs 24 are cut through the full depth of wedge 16 and are located on midline 25 with their centers 1½" and 2½" respectively from the back end of wedge 16. Air reservoirs 24 may vary in diameter provided they are sufficiently large to hold a reasonable volume of air but not so wide as to weaken substantially the structural integrity of wedge 16, e.g., between about ¼" and 1" in diameter. Five parallel channels 26 are cut transversely into the top surface of wedge 16 and are spaced 1" apart. The two rearmost channels 26 intersect the centers of air reservoirs 24. Channels 26 have u-shaped cross-sections and have depths of 7 mm, 7 mm, 6 mm, 5 mm and 3 mm, respectively, in order beginning with the rearmost channel.

Midsole 18, as shown in FIG. 3, is a ⅜" thick slab of EVA sponge tapered in thickness toward the front of the shoe. Midsole 18 is pierced by 34⅛" diameter air holes 27. In the front part of midsole 18, 26 of the air holes 27 are arranged at the intersections of a grid of parallel longitudinal lines 28 and parallel transverse lines 30, as illustrated. Adjacent transverse lines 30 are 17/16" apart and adjacent longitudinal lines 28 are ½" apart. One longitudinal line 28 is located on midline 32 of midsole 18. Through the full depth of the rear part of midsole 18 are cut two ¾" diameter air reservoirs 34 whose centers lie on midline 32 at distances of 1½" and 2½" respectively from the back end of midsole 18. Eight air holes 27 are arranged around air reservoirs 34, as illustrated.

Insole board 20, as shown in FIG. 4, is a 2½" iron thick fiber board pierced by 38⅛" diameter air holes 36 arranged at the intersections of a grid of parallel longitudinal lines 38 and parallel transverse lines 40, as illustrated. Adjacent transverse lines 40 are 17/16" apart and adjacent longitudinal lines 38 are ½" apart. One longitudinal line 38 is located on midline 42 of insole board 20.

Slipsole 22, as shown in FIGS. 5 and 6, is molded foam rubber having a thickness of 10 millimeters at its back end and 4 millimeters at its front end. A grid of seven parallel longitudinal channels 44 and ten parallel transverse channels 46 are molded into the bottom surface of slip sole 22. Longitudinal channels 44 are ⅛" wide and are spaced ½" apart. One longitudinal channel 44 is located on midline 48 of slipsole 22. Parallel transverse channels 46 are ⅛" wide and are spaced 17/16" apart. Fifty-three ⅛" airholes 50 pierce slipsole 22 at the intersections of the channels, as llustrated. Transverse channels 46 and longitudinal channels 44 vary in depth from 2 millimeters at the front of slipsole 22 to 4 millimeters at the back of slipsole 22. Air holes 27, 36 and 50 can vary in diameter provided they are large enough to permit free air flow but not so large as to weaken substantially the structural integrity of slipsole 22, insole board 20 and midsole 18, e.g., between about 1/16" and 3/16".

ASSEMBLY AND OPERATION

In the finished shoe, as illustrated in FIGS. 7 and 8, the sole pieces and shoe upper 12 are assembled as follows. Wedge 16 is cemented to outsole 14 which effectively closes off the bottom openings in wedge 16. Midsole 18 is cemented to wedge 16 and outsole 14 with midsole midline 32 oriented above and in line with wedge midline 25, and with midsole air reservoirs 34 situated immediately above wedge air reservoirs 24. In this manner the upper openings of slots 23 are closed off, except that four air holes 27 lying on midsole midline 32 open into the middle slot 23 in wedge 16. The outsole-wedge-midsole assembly is cemented to insole board 20 and to shoe upper 12 with insole board midline 42 oriented above and in line with midsole midline 32, and with the insole board grid of longitudinal lines 38 and transverse lines 40 oriented immediately above and in line with the midsole grid of longitudinal lines 28 and transverse lines 30. In this manner the upper openings of air reservoirs 34 are closed off, and insole board air holes 36 open into midsole air holes 27 with three of insole board air holes 36 opening into three of the four midsole air holes 27 which open into middle slot 23. Slipsole 22 is placed or glued inside the shoe on top of insole board 20 with transverse channels 46 and longitudinal channels 44 oriented above and in line with the insole board grid of longitudinal lines 38 and transverse lines 40. Transverse channels 26 are bored into wedge 16 after the shoe is assembled.

In the assembled shoe fresh air is free to pass into channels 26 and then into slots 23 and air reservoirs 24 and 34. Air held in slots 23 and reservoirs 24 and 34 is free to pass into middle slot 23 and then up through three of midsole air holes 27 and insole board air holes 36 into the grid of slipsole channels 44 and 46 and then through slipsole air holes 50 into the shoe. Insole board air holes 36 and midsole air holes 27 which lie below and in line with slipsole air holes 50 also serve as air reservoirs for air passing along channels 44 and 46. Air which flows into the shoe cools and ventilates the foot and passes out through the breathable material of shoe upper 12.

Because wedge 16, midsole 18, and slipsole 22 are resilient sponge material, the repeated striking of the wearer's foot against the ground will cause a compression of air reservoirs 24 and 34, slots 23, midsole air holes 27, and slipsole channels 44 and 46, causing them to act as bellows to constantly force fresh air into the shoe, thereby vastly improving the cooling and ventilating effects, while at the same time providing shock absorption to cushion the impact of the user's foot against the ground.

What is claimed is:

1. In an athletic shoe for ventilating the user's foot, having inside said shoe a resilient slipsole above an insole board, and outside said shoe a resilient outsole assembly underneath said insole board, said outsole assembly containing at least one transverse first air channel open at its ends through the side walls of said outsole assembly to the surrounding air, a system for conveying air from said first air channel into said inside of said shoe comprising:

at least one air reservoir cut vertically into said outsole assembly and spaced from the perimeter of said outsole assembly, said reservoir being closed at its top and its bottom and open through its side wall to said first air channel;

at least one air slot cut longitudinally into said outsole assembly and spaced from the perimeter of said outsole assembly, said air slot being open in one section to said side wall of said air reservoir;

at least one first air hole cut vertically into the top of said outsole assembly at a point spaced from said air reservoir, said first air hole open to said air slot;

at least one second air hole cut vertically into said insole board said second air hole being arranged to communicate with said first air hole;

at least one second air channel cut horizontally into the bottom of said slipsole, said second air channel being arranged to communicate with said second air hole; and at least two third air holes cut vertically into said slipsole said third air holes arranged to communicate with said second air channel and with the inside of said shoe, whereby said surrounding air will flow through said first air channel into said air reservoir where a volume of air is held, then into said air slot, then into said first air hole, then into said second air hole, then into said second air channel, then into said third air holes and then into the inside of said shoe to ventilate said user's foot, the force of said user's foot against the ground will enhance the flow of air into said inside of said shoe, and the user's foot will be cushioned from shock.

2. The shoe of claim 1 in which the axis of said air reservoir intersects the longitudinal midline of said outsole assembly, the midline of said air slot lies in the same plane as said outsole assembly midline, the axis of said first air hole intersects said outsole assembly midline, and the axis of said second air hole intersects said outsole assembly midline.

3. The shoe of claim 1 in which said outsole assembly comprises a midsole having its top surface attached to said insole board, a heel wedge extending at least half way from the back end of said shoe to the front end of said shoe, said heel wedge having its top surface attached to the bottom surface of said midsole, and a sole cover having its bottom surface touching the ground and having its top surface attached to the bottom surface of said heel wedge and to a portion of the bottom surface of said midsole, said air reservoir is cut through said heel wedge and said midsole, said air slot is cut through said heel wedge, and said first air hole is cut through said midsole.

4. The shoe of claim 1 in which there are two of said air reservoirs, each between about ¼" and 1" in diameter, there are three of said air slots, each between about ⅛" and ¼" wide, said second air channels comprise longitudinal second air channels and transverse second air channels arranged on a grid of intersecting lines, said longitudinal second air channels extending substantially the entire length of said shoe and said transverse second air channels extending substantially the entire width of the shoe, the midline of one of said longitudinal second air channels being in the same plane as said outsole assembly midline, a plurality of said first air holes are arranged below the intersection points on said grid, a plurality of said second air holes are arranged below the intersection points on said grid, and a plurality of said third air holes are arranged above the intersection points on said grid.

5. The shoe of claim 1 in which said first air holes, said second air holes and said third air holes are between about 1/16" and 3/16" in diameter.

6. In an athletic shoe for ventilating the user's foot, having inside said shoe a resilient slipsole above an insole board, and outside said shoe a resilient outsole assembly containing at least one transverse first air channel open at its ends through the side walls of said outsole assembly to the surrounding air, and means for conveying air from said first air channel into said inside of said shoe, that improvement comprising:

at least one enlarged air reservoir cut vertically into the heel portion of said outsole assembly and spaced from the perimeter of said outsole assembly, said enlarged air reservoir being closed at its top and its bottom, open through its side wall to said first air channel, and open to said air conveying means, whereby a volume of air will be held in said enlarged air resevoir, the force of said user's foot against the ground will enhance the flow of air into said shoe, and the user's foot will be cushioned from shock.

7. An athletic shoe comprising an upper, and a sole assembly defining a network of air passages connecting the air inside said upper with the air outside said shoe, said network comprising at least two layers of horizontally-extending air channels connected by vertically-extending air holes and one or more enlarged air reservoirs communicating with one or more of said air channels, said enlarged air reservoir being cut vertically into said outsole assembly and spaced from the perimeter of said outsole assembly in the heel portion of said outsole assembly, and being closed at its top and its bottom, wherein said sole assembly is sufficiently resilient that the compression of said sole assembly between the foot and the ground pumps air held in said air reservoir into the inside of said upper.

8. In an athletic shoe for ventilating the user's foot, having inside said shoe a resilient slipsole above an insole board, and outside said shoe a resilient outsole assembly underneath said insole board, said outsole assembly containing at least one transverse first air channel open at its ends through the side walls of said outsole assembly to the surrounding air, at least one enlarged air reservoir cut vertically into said outsole assembly and spaced from the perimeter of said outsole assembly, said enlarged air reservoir being closed at its top and its bottom, and open through its side wall to said first air channel, and at least two layers of networks of horizontally-extending air channels, one of said networks being formed in said outsole assembly and one of said networks being formed in said slipsole, said networks being connected by vertically-extending air holes, wherein said sole assembly is sufficiently resilient that the compression of said sole assembly between the foot and the ground pumps air held in said enlarged air reservoir into the inside of said shoe and around said foot.

* * * * *